US007384241B2

(12) United States Patent
Watanabe et al.

(10) Patent No.: US 7,384,241 B2
(45) Date of Patent: Jun. 10, 2008

(54) FAN WITH RING AND METHOD OF PRODUCING THE SAME

(75) Inventors: Kazuhiro Watanabe, Yokaichi (JP); Takahiro Kawabe, Yokaichi (JP)

(73) Assignee: Toyo Radiator Co., Ltd., Tokyo (JP)

( * ) Notice: Subject to any disclaimer, the term of this patent is extended or adjusted under 35 U.S.C. 154(b) by 359 days.

(21) Appl. No.: 10/529,941

(22) PCT Filed: Oct. 2, 2003

(86) PCT No.: PCT/JP03/12705

§ 371 (c)(1),
(2), (4) Date: Apr. 1, 2005

(87) PCT Pub. No.: WO2004/031589

PCT Pub. Date: Apr. 15, 2004

(65) Prior Publication Data

US 2006/0292008 A1 Dec. 28, 2006

(30) Foreign Application Priority Data

Oct. 4, 2002 (JP) ..... 2002-292990
Feb. 28, 2003 (JP) ..... 2003-054605

(51) Int. Cl.
*F01D 5/22* (2006.01)

(52) U.S. Cl. ..... 416/192; 29/889.3; 29/557

(58) Field of Classification Search ..... 416/189, 416/192; 29/557, 889.3
See application file for complete search history.

(56) References Cited

U.S. PATENT DOCUMENTS 1,072,189 A * 9/1913 Sparks ..... 416/189
2,779,424 A * 1/1957 Lyon ..... 416/192
3,189,982 A * 6/1965 Merz ..... 29/889.3
4,733,586 A * 3/1988 Manusch et al. ..... 83/39

* cited by examiner

*Primary Examiner*—Edward K. Look
*Assistant Examiner*—Devin Hanan
(74) *Attorney, Agent, or Firm*—Jordan and Hamburg LLP

(57) ABSTRACT

To provide a method of forming a fan with ring in one piece from a single metal plate and to provide the fan formed using the method, the metal plate is plastically worked into a shallow pan shape so as to form a cylindrical ring portion 1 on the periphery. A boss portion 2 is then formed at the center of the bottom portion of the pan shape, cutting all portions, except for part of the front end edge along the radius of each of blade portions 3 and part of the edge of the ring portion 1 for use as connection portions 4 so that the plurality of radial blade portions 3 are slit and formed.

9 Claims, 6 Drawing Sheets

FAN WITH RING AND METHOD OF PRODUCING THE SAME

TECHNICAL FIELD

The present invention relates to a fan with ring used as an airflow-generating fan for an automobile radiator and so on and to a method for manufacturing the same.

BACKGROUND ART

A fan installed at the back or front side of an automobile radiator, etc. is known front ends of whose radial blade portions are joined in one piece by a cylindrical ring. FIG. 8 illustrates an example of such a fan or a resin fan 12 in which a number of blade portions 3 are arranged radially on the outer perimeter of a boss portion 2, in which the front end edges of the blade portions 3 along the radius are connected to the inner surface of a bellmouth-shaped ring portion 1 in one piece and in which the blade portions 3, the boss portion 2 and the ring portion 1 are integrally molded from synthetic resin. The blade portions 3 have a shape twisted at a given angle relative to the plane in FIG. 8A.

A center hole 7 is provided at the center of the boss portion 2, and a motor rotary shaft is inserted into and fixed in the center hole 7.

A conventional fan with ring made of resin are manufactured by injection molding and has the drawback that the overall weight becomes heavier because of the need to make the blade portions 3, the boss portion 2 and so on as thick as or thicker than a given thickness for convenience of molding and in respect of strength.

It has also been difficult heretofore to ensure exact uniformity in thickness of all the blade portions 3, thus resulting in quality-related problems such as slight fan imbalance during rotation.

Further, there has been a possibility of resin shrinkage, deformation and other problems associated with molding during injection molding.

In order to solve the aforementioned problems, it is an object of the present invention to form in one piece a fan with ring by press-molding a single uniform metal plate. It is another object of the present invention to provide a manufacturing method thereof that ensures ease of manufacture and high quality.

DISCLOSURE OF THE INVENTION

The invention as defined in a first aspect of the invention provides a fan with ring comprising:

a cylindrical ring portion (1); and a plurality of blade portions (3) located within the ring portion (1) and projected radially from a boss portion (2) at the center, wherein the fan with ring comprises connection portions (4) constituted by connecting in one piece part of the front end edge of each of the blade portions (3) with part of the edge of the ring portion (1), and wherein the blade portions (3), the ring portion (1) and the boss portion (2) are molded in one piece from a press-molded form of a single metal plate.

The invention as defined in a second aspect of the invention provides the fan with ring according to the first aspect of the invention, wherein the blade surface of each of the blade portions (3) has a sloped plane twisted relative to a plane of the boss portion (2), and wherein the connection portions (4) at the front ends of the blade portions (3) are formed in one piece such that sloped concave portions (16), that are diagonally depressed, with the edges included in the ring portion, are flush with the sloped planes.

The invention as defined in a third aspect of the invention provides a method of manufacturing a fan with ring comprising the steps of:

plastically working a metal plate into a shallow pan shape so as to form a cylindrical ring portion (1) on the periphery; and forming a boss portion (2) at the center of the bottom portion of the pan shape, slitting and forming blade portions (3) radially from the boss portion (2), and cutting all portions except for part of the front end edge along the radius of each of the blade portions (3) and part of the edge of the ring portion (1) for use as the connection portions (4).

The invention as defined in a fourth aspect of the invention provides the method of manufacturing a fan with ring according to the third aspect of the invention, comprising, after the step of plastically working a metal plate into a shallow pan shape, the steps of:

forming the boss portion (2) at the center of the bottom portion of the pan shape, and cutting at least the contours of both edges along the width of each of the blade portions (3) in order to form the plurality of blade portions (3) radially from the boss portion (2); and then cutting all portions, except for part of the front end edge along the radius of each of the blade portions (3) and part of the edge of the ring portion (1) for use as the connection portions (4), and twisting each of the blade portions (3) relative to the boss portion (2) for plastic working.

The invention as defined in a fifth aspect of the invention provides the method of manufacturing a fan with ring according to the third aspect of the invention, comprising, after the step of plastically working a metal plate into a shallow pan shape, the steps of:

forming the boss portion (2) at the center of the bottom portion of the pan shape, cutting all the contours of the plurality of blade portions (3) except for both edges along the width and part of the front end portion of each of the blade portions (3) in order to form the plurality of blade portions (3) radially from the boss portion (2), and forming enlarged hole portions (13) for crack prevention at the contour edges of the front end portions; and then cutting all portions, except for part of the front end edge along the radius of each of the blade portions (3) and part of the edge of the ring portion (1) for use as the connection portions (4), and twisting each of the blade portions (3) relative to the boss portion (2) for plastic working.

The invention as defined in a sixth aspect of the invention provides a method of manufacturing a fan with ring comprising the steps of:

plastically working a metal plate into a shallow pan shape so as to form a cylindrical ring portion (1) on the periphery;

forming a plurality of sloped concave portions (16) for formation of blade portion sloped surfaces on the outer side of the pan bottom, the sloped concave portions (16) being evenly spaced apart from one another along the circumference and being depressed radially from the center of the pan bottom, with the edges of the sloped concave portions (16) included in the peripheries of the pan shape; and forming the boss portion (2) at the center of the bottom portion of the pan shape, slitting and forming the blade portions (3) radially from the boss portion (2) such that the sloped concave portions (16) constitute part of the respective blade portions, and cutting all portions, except for the boundary between at least the front edge portion along the radius of each of the blade portions (3) and the ring portion (1) for use as the connection portion, such that the boundary constitutes the sloped concave portion (16) in itself.

The invention as defined in a seventh aspect of the invention provides the method of manufacturing a fan with ring according to any of the third to the sixth aspects of the invention, wherein the enlarged hole portions (13) for crack prevention are formed in advance on both ends of the connection portions (4).

The invention as defined in an eighth aspect of the invention provides the method of manufacturing a fan with ring according to any of the third to the seventh aspects of the invention, comprising, after the step of plastically working a metal plate into a shallow pan shape, the step of:

forming notches (15) in advance from the inside of the pan bottom at the positions of the front end edges of the blade portions (3) at the boundary between the bottom edge of the pan and the periphery of the ring portion (1) of the pan, the notches (15) not stretching to the outer surface of the metal plate.

The fan with ring and its manufacturing method of the present invention are configured as described above and produces the effect described below.

The fan with ring of the present invention has connection portions 4 constituted by integrally connecting part of the front end edges of the blade portions 3 with the edge of the ring portion 1, with the blade portions 3, the ring portion 1 and the boss portion 2 formed in one piece from a press-molded form of a single metal plate, thus ensuring ease of manufacture and uniform thickness and providing a well-balanced and high-performance fan.

It is also possible to use a relatively thin metal plate, thus providing a fan that is lightweight as a whole.

In the above configuration, the blade portions 3 have sloped planes twisted relative to the plane of the boss portion 2, and the connection portions 4 between the blade portions 3 and the ring portion 1 can be formed in one piece such that sloped concave portions 16, depressed diagonally including the ring portion 1, are flush with the sloped planes of the blade portions 3.

In this case, it is possible to form the robust connection portions between the blade portions 3 and the ring portion 1, thus providing a long-life fan with ring.

Further, the manufacturing method of the present invention has a step of plastically working the metal plate into a pan shape so as to form the cylindrical ring portion 1 on the periphery and providing the boss portion 2 at the center of the bottom portion and another step of forming the blade portions 3 by cutting out the blade portions radially from the boss portion 2 and cutting all portions except for the connection portions 4 between part of the front end edges of the blade portions 3 along the radius and part of the edge of the ring portion 1, thus allowing manufacture of a fan with ring from a single metal plate without undue efforts. This provides an inexpensive fan with ring with small part count.

In the foregoing manufacturing method, it is possible to conduct plastic working of the blade portions 3 in which the blade portions 3 are twisted relative to the boss portion 2. This provides a fan with ring with a high airflow-generating capability.

To form the plurality of blade portions 3 radially from the boss portion 2, the manufacturing method can be provided with a step of cutting the contours of the blade portions 3 except for both edges along the width and part of the front end portions of the blade portions 3 and another step of forming enlarged hole portions 13 for crack prevention at the contour edges of the front end portions of the blade portions 3. This prevents cracking at the base portion between the blade portions 3 and the ring portion 1 during plastic working in which the blade portions 3 are twisted relative to the boss portion 2.

The manufacturing method allows, after plastic working of the metal plate into a shallow pan shape, formation of the plurality of sloped concave portions 16 for formation of sloped surfaces of the blade portions on the pan bottom outer surface side; the periphery portions of the sloped concave portions 16 including their edges and the sloped concave portions 16 being evenly spaced from one another along the circumference and being depressed radially from the pan center. In order for the front end portions of the blade portions 3 along the radius and part of the edge of the ring portion 1 to constitute the sloped concave portions 16 in themselves, these portions can be left uncut as the connection portions 4. This provides a highly strong, crack-resistant and presentable fan with ring.

The manufacturing method allows advance formation of the enlarged hole portions 13 for crack prevention on both ends of the connection portions 4. This provides a further robust fan with ring.

Any of the aforementioned manufacturing methods can be provided with a step of forming, in advance and from the inside of the pan bottom, notches 15 not stretching to the outer surface of the metal plate at the boundary between the pan edge and the ring portion 1 periphery and at the front end edges of the blade portions, following the step of plastically working the metal plate into the shallow pan shape. This prolongs mold life and ensures accuracy and reliability in formation of the fan blade portions.

BEST MODE FOR CARRYING OUT THE INVENTION

Embodiments of the present invention will now be described with reference to the accompanying drawings.

Figure 1A:
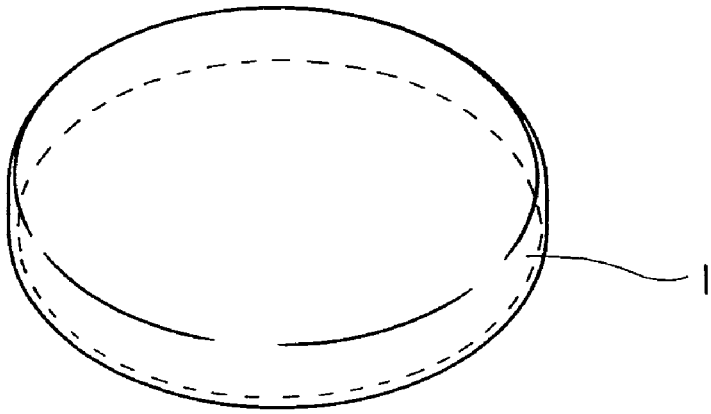
FIGS. 1A, 1B and 1C illustrate explanatory views showing in succession steps of molding a fan with ring of the present invention from a single metal plate.
Figure 1B:
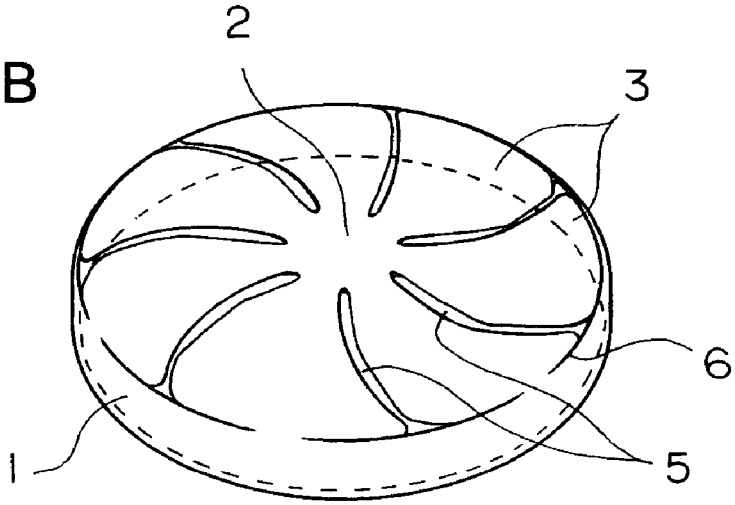
Figure 1C:
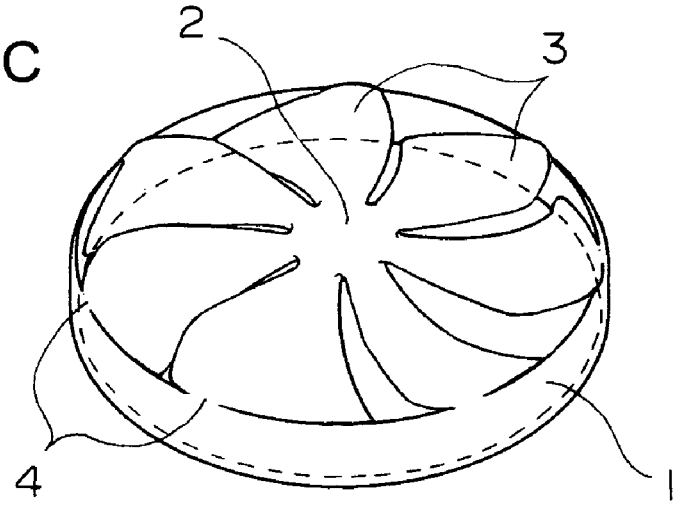
Figure 2A:
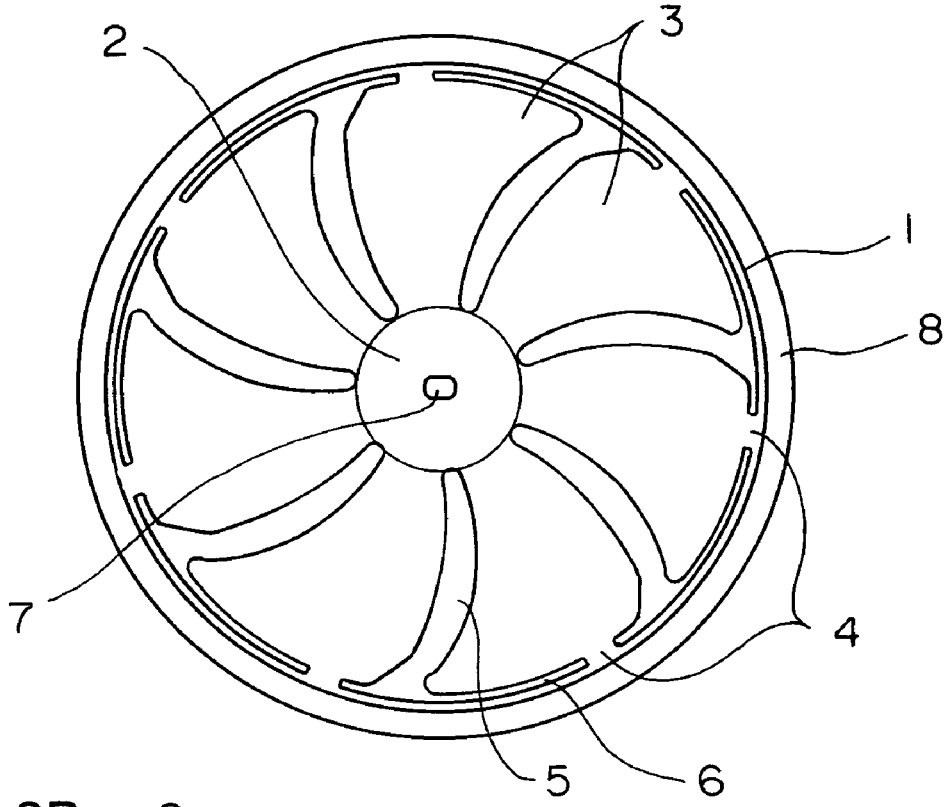
FIG. 2A illustrates a front view of the fan with ring manufactured by the manufacturing method of the present invention.
Figure 2B:
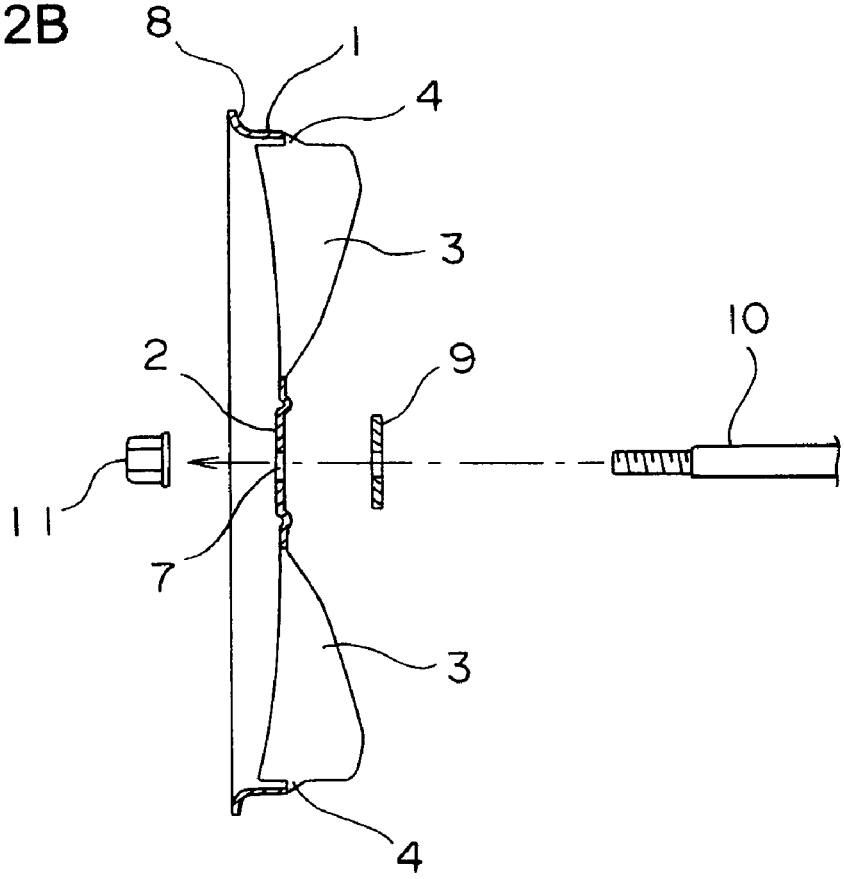
FIG. 2B illustrates a vertical sectional view of the fan with ring manufactured by the manufacturing method of the present invention.

FIGS. 1A to 1C show in succession the manufacturing steps of the fan with ring of the present invention while FIGS. 2A and 2B illustrate front and vertical sectional views of the fan with ring manufactured by the manufacturing method of the present invention.

The fan with ring is manufactured by press-molding a thin metal plate such as aluminum or stainless steel plate. The metal plate is first deep-drawn into a shallow pan shape so as to form the cylindrical ring portion 1 on the outer perimeter as shown in FIG. 1A.

Next, the boss portion 2 is formed at the center of the bottom portion of the pan shape, and slightly bending radial slits 5 are blanked at boundaries between the blade portions 3 such that a number of the blade portions 3 are arranged radially from the boss portion 2 as shown in FIG. 1B.

Next, all portions are cut, except for the connection portions 4 between part of the front end edges of the blade portions 3 along the radius and part of the edge of the ring portion 1, and the blade portions are subjected to bending in which the blade portions 3 are twisted in the same direction relative to the boss portion 2 as shown in FIG. 1C.

Note that the center hole 7 is drilled at the center of the boss portion 2 as shown in FIGS. 2A and 2B. Drilling of the center hole 7 can be carried out concurrently with the step shown in FIG. 1B or 1C. The center hole 7 may also be drilled after either of the steps.

The edge portion on the air inlet side of the ring portion 1 is slightly expanded, thus forming a bellmouth portion 8 as shown in FIG. 2B. The blade portions 3 are twisted as shown in FIG. 2B, with part of the back side of each of the blade portions 3 projecting more backward than the back end edge of the ring portion 1.

The fan with ring thus constructed has the front end portion of a motor rotary shaft 10 not shown inserted into the center hole 7 of the boss portion 2 via a spacer 9, with a nut 11 screwed up and tightened on the front side of the fan with ring.

Figure 3:
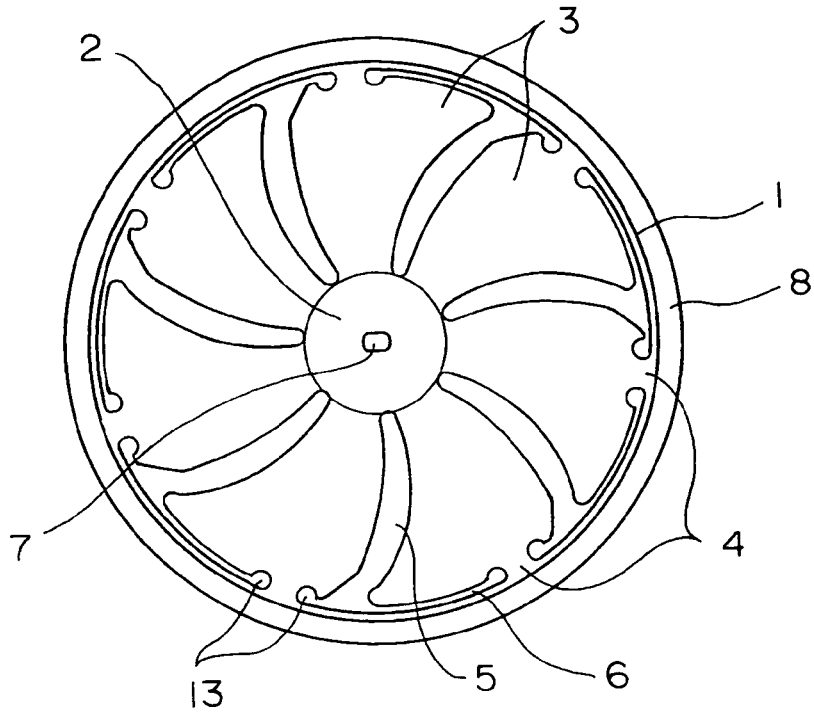
FIG. 3 illustrates a front view of another embodiment of the fan with ring of the present invention.

Next, FIG. 3 shows a second embodiment of the fan of the present invention. In this example, the enlarged hole portions 13 are provided on both sides of each of the circumferential slits 6 of the fan shown in FIG. 2A.

Figure 4:
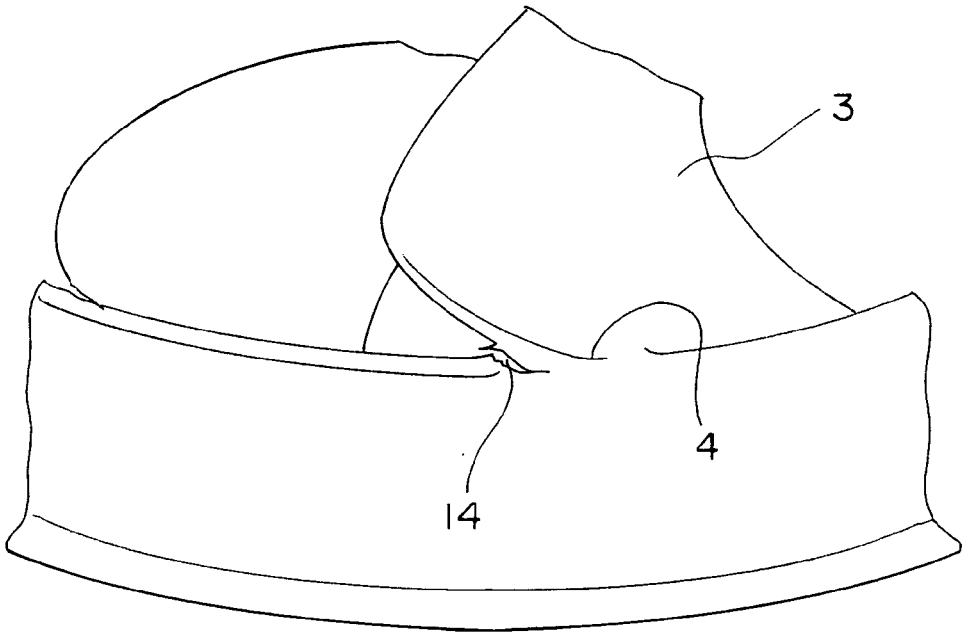
FIG. 4 illustrates an explanatory perspective view of a cracked portion 14 in a connection portion 4 when the embodiment in FIG. 3 is not provided with enlarged hole portions 13.

The enlarged hole portions 13 are designed to prevent occurrence of a cracked portion 14 shown in FIG. 4 at the boundary between the circumferential slits 6 and the connection portions 4 when the connection portions 4 formed between both ends of the circumferential slits 6 undergo plastic deformation in which the connection portions 4 are twisted. In the absence of the enlarged hole portions 13, when the plane of the blade portion 3 is sloped by press-molding, twisting occurs in the connection portions 4, occasionally resulting in a crack between the connection portions and the circumferential slits 6.

To form the enlarged hole portions 13, it suffices to drill in advance circular holes spaced from one another at the corresponding positions and form the circumferential slit 6 between each pair of the circular holes later. Thus, formation of the enlarged hole portions 13 at the ends of the circumferential slits 6 prevents cracking to the extent possible as stress concentration is difficult to take place at the boundary between the circumferential slits 6 and the connection portions 4 even when the blade portions 3 are twisted around the connection portions 4.

Figure 5:
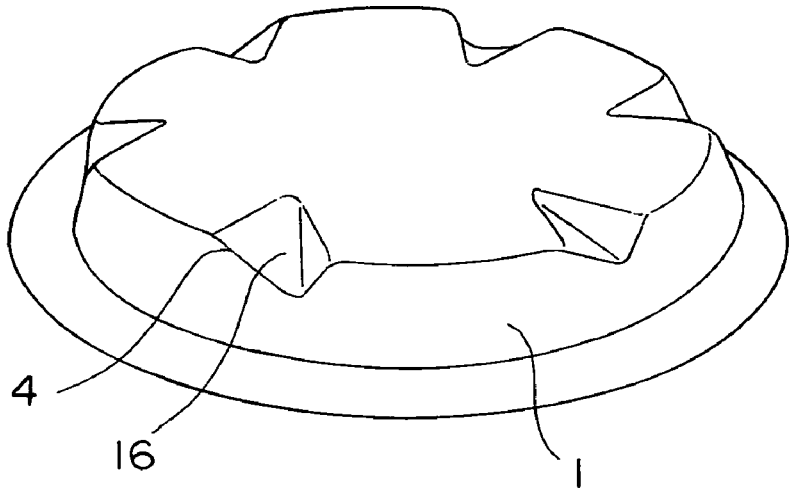
FIG. 5 illustrates a perspective view of an intermediate step of another manufacturing method of the fan with ring of the present invention.
Figure 6:
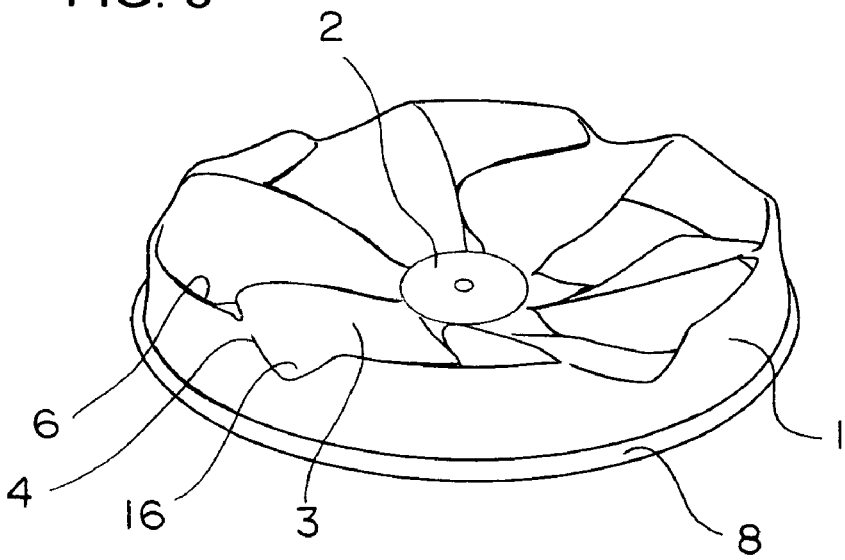
FIG. 6 illustrates a perspective view of a final step of the same fan with ring.
Figure 7A:
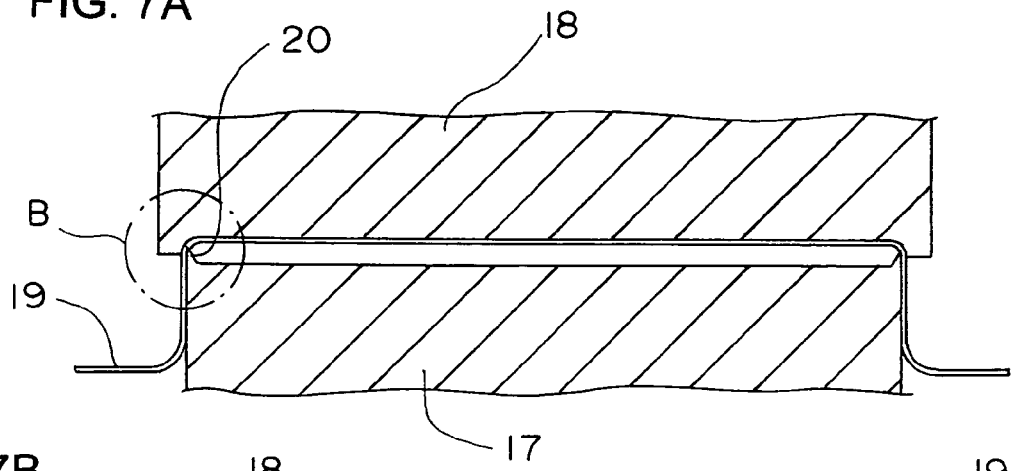
FIGS. 7A, 7B, 7C and 7D illustrate preliminary steps of forming circumferential slits 6 in the fan with ring of the present invention, with FIG. 7A being an overall vertical sectional view, FIG. 7B being an expanded view of part B in FIG. 7A, FIG. 7C being an expanded sectional view of a notch 15 formed by the step, and FIG. 7D being an explanatory bottom view of the notches 15.
Figure 7B:
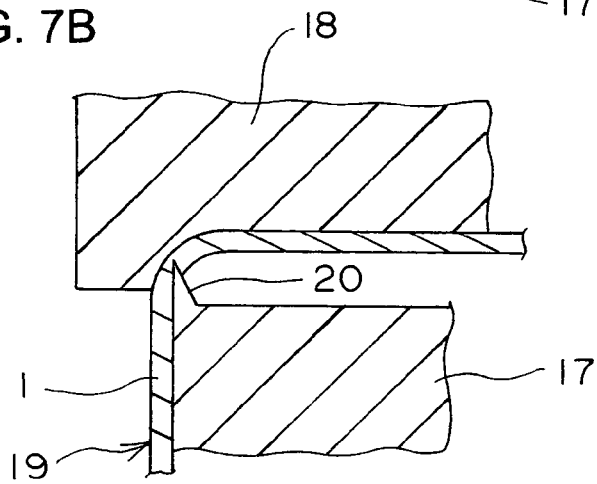
Figure 7C:
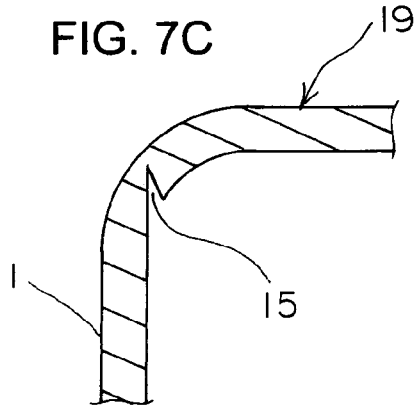
Figure 7D:
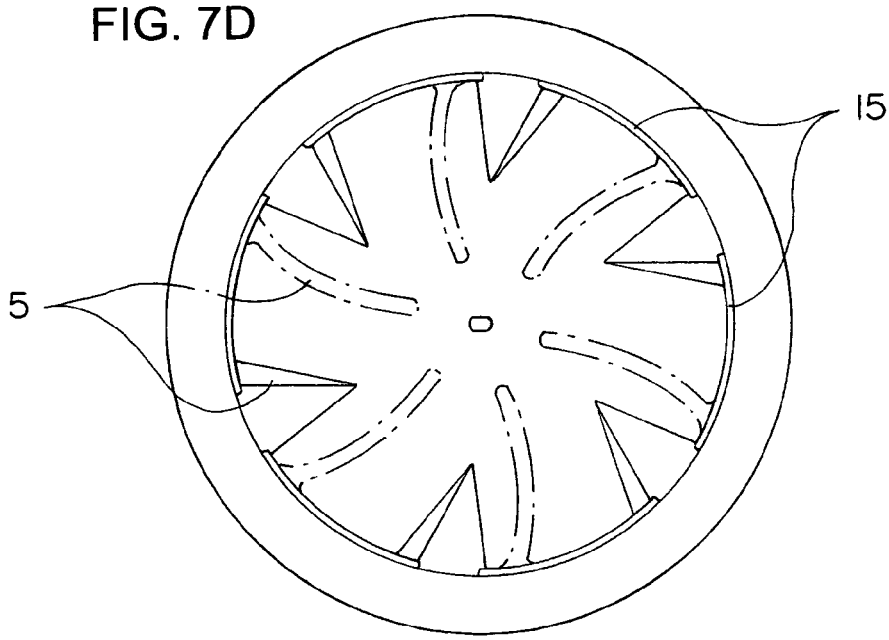
Figure 8A:
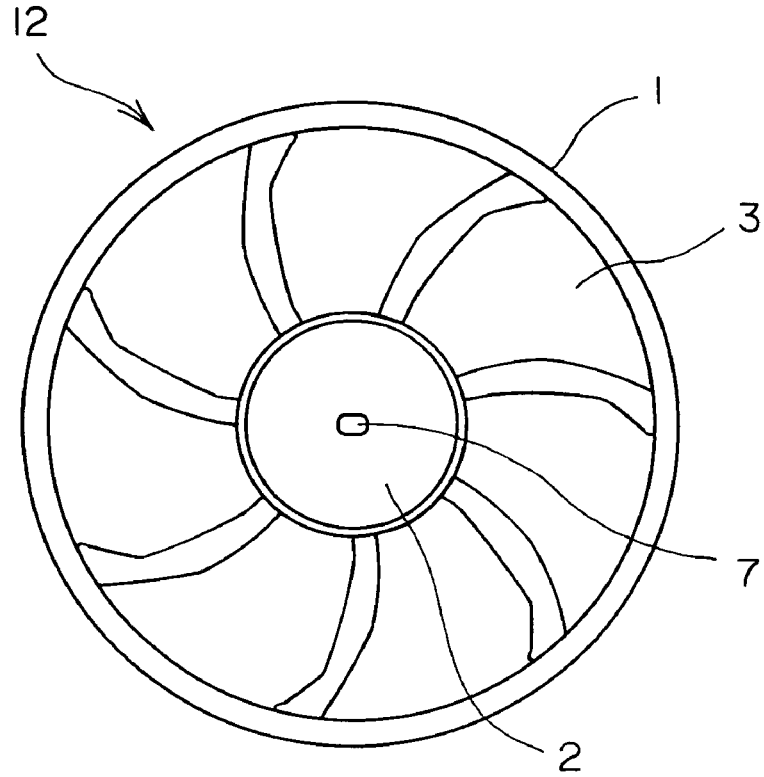
FIG. 8A PRIOR ART
FIGS. 8A and 8B respectively illustrate a front view and vertical sectional view of a conventional ring-equipped resin fan 12.
Figure 8B:
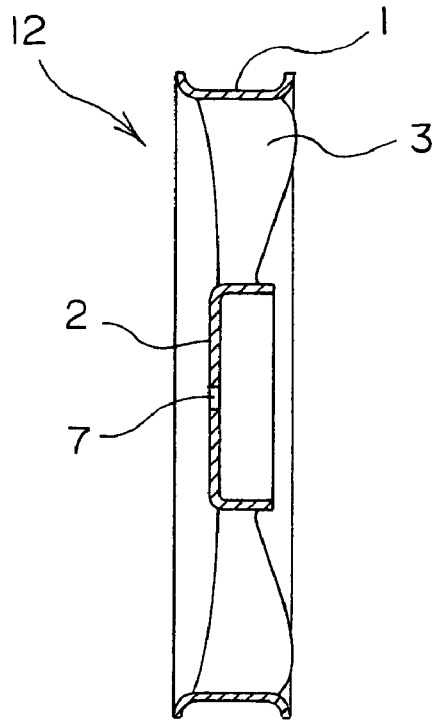
FIG. 8B PRIOR ART

Next, FIGS. 5 and 6 illustrate perspective views of a third embodiment of the fan with ring of the present invention. FIGS. 5 and 6 show in succession the manufacturing steps.

In this example, a metal plate is first press-molded into a pan shape through deep drawing as was done in FIG. 1A. Next, the sloped concave portions 16 are formed equidistantly along the circumference in the second deep drawing step as shown in FIG. 5. The sloped concave portions 16 are formed radially from the center to the periphery, with the cross section formed into an odd V shape. The front end portions of the sloped concave portions 16 are depressed including the periphery of the ring portion 1.

Next, the boss portion 2 is formed at the center of the bottom portion of the pan shape, and the blade portions 3 are slit and formed radially from the boss portion 2 as shown in FIG. 6. At this time, the front end portion of the blade portion 3 along the radius is cut only where the sloped concave portion 16 does not exist, thus making the sloped concave portion 16 in itself part of the blade surface of the blade portion 3. The sloped concave portion 16 in itself is the sloped surface of the blade portion 3 formed in advance for the boss portion 2. Only both sides of the blade portion 3 extending along the radius and part of its front end are slit and formed. Note that all the remaining sloped concave portion 16, except for the portion that will be the blade portion 3, is cut off in slit form. This perfectly prevents occurrence of the cracked portion 14 described with reference to FIG. 4.

FIGS. 7A, 7B, 7C and 7D illustrate working means for forming the respective circumferential slits 6 shown in FIGS. 1 to 3 and FIG. 6.

As an example, the boundary portions between the ring portion 1 of the metal plate formed into a shallow pan shape and the pan bottom are notched at even spacings from the inner surface side of the pan to form the notches 15 as shown in FIGS. 7A, 7B, 7C and 7D at the circumferential slit 6 positions shown in FIG. 1A. The notches 15 not stretching to the outer surface of a pan-shaped metal plate 19 are formed by notching the pan-shaped metal plate 19 using an edge portion 20 projected intermittently on the periphery of a lower mold 17. This is designed to prevent excessive wear of molds used to form the circumferential slits 6 shown in FIG. 2.

It should be borne in mind that while a crack may occur that stretches from the notch 15 to the outer surface of the pan-shaped metal plate 19 after formation of the notches 15, this does not present any practical problems because this portion will be later slit and formed.

Then, the radial slits 5 are formed and blanked. The blade portions are plastically deformed so as to be twisted by other press mold. This allows the front edge of the blade surface, except for part of the edge, to be cut and the blade surface to be twisted and sloped relative to the boss portion because of existence of the notch 15.

Note that when the notches are formed, the pan-shaped metal plate 19 is clamped between an upper mold 18 and the lower mold 17 and part of the pan-shaped metal plate 19 is notched by the edge portion 20.

Thus, provision of the notches 15 in advance ensures easy formation of the circumferential slits 6 and long life of the edge portion 20 of the lower mold 17.

The invention claimed is:

1. A fan with ring comprising:

a cylindrical ring portion having a generally cylindrical outer face, said cylindrical outer face having a first end and a second end; and a plurality of blade portions located within the ring portion and projected radially from a boss portion, wherein the fan with ring comprises connection portions constituted by connecting in one piece part of a front end edge of each of the blade portions with part of an edge of the ring portion, the blade portions, the ring portion, and the boss portion are molded in one piece from a press-molded form of a single metal plate, a blade surface of each of the blade portions has a sloped plane twisted relative to a plane of the boss portion, the connection portions at the front ends of the blade portions are formed in one piece such that sloped concave portions, that are diagonally depressed, with edges included in the ring portion, are flush with the sloped planes, said first end of said cylindrical outer face comprises outer peripheral arcuate segments, said edges of said sloped concave portions which are included in the ring portion are continuous with said arcuate segments, said edges of said sloped concave portions extending away from said first end of said cylindrical outer face towards said second end of said cylindrical outer face, said edges of said sloped concave portions converging from respective said arcuate segments towards said second end of said cylindrical outer face.

2. A method of manufacturing a fan with ring comprising:

plastically working a metal plate into a shallow pan shape so as to form a cylindrical ring portion on a periphery of said pan shape;

forming notches inside of the pan bottom at positions corresponding to front end edges of blade portions at a boundary between a bottom edge of the pan and the periphery of the ring portion of the pan, the notches not stretching to an outer surface of the metal plate;

forming a boss portion at a center of a bottom portion of the pan shape;

slitting and forming blade portions radially from the boss portion;

and cutting around blade and ring portions except for part of a front end edge of each of the blade portions, part of the edge of the ring portion for use as connection portions, and a part connecting the blade portions with the boss portion.

3. A fan with ring produced according to the method of claim 2.

4. A method of manufacturing a fan with ring comprising:

plastically working a metal plate into a shallow pan shape so as to form a cylindrical ring portion on a periphery of said pan shape;

forming notches inside of a pan bottom at positions corresponding to front end edges of blade portions at a boundary between a bottom edge of the pan and the periphery of the ring portion of the pan, the notches not stretching to an outer surface of the metal plate;

forming a boss portion at a center of a bottom portion of the pan shape;

cutting at least contours of both edges along sides of each of blade portions in order to form a plurality of blade portions radially from the boss portion;

cutting around blade and ring portions, except for part of a front end edge of each of the blade portions, part of the edge of the ring portion for use as connection portions, and a part connecting the blade portions with the boss portion; and twisting each of the blade portions relative to the boss portion.

5. A method of manufacturing a fan with ring comprising:

plastically working a metal plate into a shallow pan shape so as to form a cylindrical ring portion on a periphery of said pan shape;

forming notches inside of a pan bottom at positions corresponding to front end edges of blade portions at a boundary between a bottom edge of the pan and the periphery of the ring portion of the pan, the notches not stretching to an outer surface of the metal plate;

forming a boss portion at a center of a bottom portion of the pan shape;

cutting all contours of a plurality of blade portions except for both edges along a width of each blade portion and part of a front end portion of each of the blade portions in order to form a plurality of blade portions radially from the boss portion;

forming enlarged hole portions at edges of the front end portions adjacent to connecting portions;

cutting around the blade and ring portions, except for part of a front end edge of each of the blade portions, part of the edge of the ring portion for use as connection portions, and a part connecting the blade portions with the boss portion; and twisting each of the blade portions relative to the boss portion.

6. A method of manufacturing a fan with ring comprising:

plastically working a metal plate into a shallow pan shape so as to form a cylindrical ring portion on a periphery, said ring portion having a generally cylindrical outer face, said cylindrical outer face having a first end and a second end;

forming a plurality of sloped concave portions for formation of blade portion sloped surfaces on an outer side of a pan bottom, the sloped concave portions being evenly spaced apart from one another along a circumference and being depressed radially from a center of a pan bottom, with edges of the sloped concave portions included in peripheries of the pan shape, said first end of said cylindrical outer face comprising outer peripheral arcuate segments and edges of said sloped concave portions being continuous with said arcuate segments, wherein said edges of said sloped concave portions extend away from said first end of said cylindrical outer face towards said second end of said cylindrical outer face, said edges of said sloped concave portions converging from respective said arcuate segments towards said second end of said cylindrical outer face;

forming the boss portion at a center of a bottom portion of the pan shape;

slitting and forming blade portions radially from the boss portion such that the sloped concave portions constitute part of the respective blade portions; and cutting around the blade and sloped concave portions, except for a part connecting the blade portions with the boss portion, and a boundary between at least a front edge portion of each of the blade portions and the ring portion for use as a connection portion, such that the boundary constitutes the sloped concave portion itself.

7. A method of manufacturing a fan with ring comprising:

plastically working a metal plate into a shallow pan shape so as to form a cylindrical ring portion on a periphery;

forming a plurality of sloped concave portions for formation of blade portion sloped surfaces on an outer side of a an bottom, the sloped concave portions being evenly spaced apart from one another along a circumference and being depressed radially from a center of a pan bottom, with edges of the sloped concave portions included in peripheries of the pan shape;

forming the boss portion at a center of a bottom portion of the pan shape;

slitting and forming blade portions radially from the boss portion such that the sloped concave portions constitute part of the respective blade portions;

cutting around the blade and sloped concave portions, except for a part connecting the blade portions with the boss portion, and a boundary between at least a front edge portion of each of the blade portions and the ring portion for use as a connection portion, such that the boundary constitutes the sloped concave portion itself; and forming notches inside of the pan bottom at positions corresponding to front end edges of blade portions at a boundary between a bottom edge of the pan and the periphery of the ring portion of the pan, the notches not extending to an outer surface of the metal plate.

8. A fan with ring comprising:

a cylindrical ring portion; and a plurality of blade portions located within the ring portion and projected radially from a boss portion, wherein the fan with ring comprises connection portions constituted by connecting in one piece part of a front end edge of each of the blade portions with part of an edge of the ring portion, the blade portions, the ring portion, and the boss portion are molded in one piece from a press-molded form of a single metal plate, a blade surface of each of the blade portions has a sloped plane twisted relative to a plane of the boss portion, the connection portions at the front ends of the blade portions are formed in one piece such that sloped concave portions, that are diagonally depressed, with edges included in the ring portion, are flush with the sloped planes, and said sloped concave portions extend to a portion of an outer side of said ring portion, and concave surfaces of said sloped concave portions face away from said ring portion.

9. A method of manufacturing a fan with ring comprising:

plastically working a metal plate into a shallow pan shave so as to form a cylindrical ring portion on a periphery;

forming a plurality of sloped concave portions for formation of blade portion sloped surfaces on an outer side of a an bottom, the sloped concave portions being evenly spaced apart from one another along a circumference and being depressed radially from a center of a pan bottom, with edges of the sloped concave portions included in peripheries of the pan shape;

forming the boss portion at a center of a bottom portion of the pan shape;

slitting and forming blade portions radially from the boss portion such that the sloped concave portions constitute part of the respective blade portion; and cutting around the blade and slaved concave portions, except for a part connecting the blade portions with the boss portion, and a boundary between at least a front edge portion of each of the blade portions and the ring portion for use as a connection portion, such that the boundary constitutes the sloped concave portion itself, wherein said sloped concave portions extend to a portion of an outer side of said ring portion, and concave surfaces of said sloped concave portions face away from said ring portion.

* * * * *

UNITED STATES PATENT AND TRADEMARK OFFICE

CERTIFICATE OF CORRECTION

PATENT NO. : 7,384,241 B2
APPLICATION NO. : 10/529941
DATED : June 10, 2008
INVENTOR(S) : Kazuhiro Watanabe et al.

It is certified that error appears in the above-identified patent and that said Letters Patent is hereby corrected as shown below:

Title page,

Item (73), Assignee, remove "Toyo Radiator Co., Ltd., Tokyo (JP)" and replace with --T.RAD Co., Ltd., Tokyo (JP)--.

Signed and Sealed this

Twentieth Day of January, 2009

JON W. DUDAS
*Director of the United States Patent and Trademark Office*